US009169594B1

(12) United States Patent
Meade

(10) Patent No.: US 9,169,594 B1
(45) Date of Patent: Oct. 27, 2015

(54) INDOOR FIRE HYDRANT AND ASSOCIATED METHOD

(76) Inventor: Melbourne Sylvester Meade, Brooklyn, NY (US)

( * ) Notice: Subject to any disclaimer, the term of this patent is extended or adjusted under 35 U.S.C. 154(b) by 780 days.

(21) Appl. No.: 12/862,842

(22) Filed: Aug. 25, 2010

Related U.S. Application Data

(60) Provisional application No. 61/236,565, filed on Aug. 25, 2009.

(51) Int. Cl.
*D06F 53/04* (2006.01)

(52) U.S. Cl.
CPC ..... *D06F 53/045* (2013.01)

(58) Field of Classification Search
CPC .... B65H 75/34; B65H 75/44; B65H 75/4457; B65H 75/446; B65H 75/4471
USPC ..... 239/197, 198; 137/355, 355.16, 355.17, 137/355.18, 355.19, 355.2, 355.21, 355.22, 137/355.24, 355.25, 355.26, 355.27, 137/355.28; 242/403, 384.7, 385.4, 395.1, 242/396.1; 169/30, 46, 51
See application file for complete search history.

(56) References Cited

U.S. PATENT DOCUMENTS 348,805 A * 9/1886 Wheeler ..... 242/381.6
2,606,067 A * 8/1952 Roark ..... 137/355.17
3,749,118 A * 7/1973 Berg ..... 137/355.28
3,942,636 A 3/1976 Matsuyama et al.
4,062,493 A * 12/1977 Suggs ..... 239/197
4,939,931 A 7/1990 Reeves
5,560,391 A * 10/1996 Bantaculo ..... 137/355.23
5,562,163 A * 10/1996 Sartain et al. ..... 169/51
6,050,291 A * 4/2000 Whitehead et al. ..... 137/355.26
6,338,360 B2 * 1/2002 Spear et al. ..... 137/355.22
7,017,603 B1 * 3/2006 Rosine et al. ..... 137/355.12
7,028,859 B2 * 4/2006 Moon et al. ..... 220/4.28
7,316,368 B2 * 1/2008 Moon et al. ..... 242/390.9
7,377,289 B1 * 5/2008 English et al. ..... 137/355.2

* cited by examiner

*Primary Examiner* — Len Tran
*Assistant Examiner* — Viet Le

(57) ABSTRACT

An indoor retractable fire extinguishing apparatus may include a portable fireproof casing adapted to be positioned inside the building structure. A spool may be rotatably situated inside the fireproof casing. A fire hose may be rolled up about the spool. A plurality of stabilizing plates may be statically mounted to the fireproof casing. A handle may be attached to the spool in such a manner that the handle and the spool may rotate in sync and thereby cause the fire hose to wind and unwind from the spool respectively while the stabilizing plates remain stationary exterior of the fireproof casing. The stabilizing plates may further be directly attached to an outer surface of the fireproof casing such that operating forces acting on the handle and the spool are absorbed and distributed along the stabilizing plates thereby maintaining the fireproof casing at a substantially stable position during winding and unwinding operations.

11 Claims, 5 Drawing Sheets

INDOOR FIRE HYDRANT AND ASSOCIATED METHOD

CROSS REFERENCE TO RELATED APPLICATIONS

This application claims the benefit of U.S. Provisional Application No. 61/236,565, filed Aug. 25, 2009, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to fire extinguisher equipment and, more particularly, to an indoor fire hydrant for providing users with an easy and accessible means of fighting the spread of a fire in and around the house.

2. Prior Art

During the last several years, the fire seasons have been particularly bad, affecting an average of more than four million acres of land in 2005, 2006, and 2007 (or more land than the states of Connecticut and Rhode Island combined.) The fires destroyed many newer homes and communities built on the edges of the forest, and the worst may be yet to come in future years. There is growing concern in the insurance industry because of a recent trend towards increased losses from wildfires and floods. Increased exposure reflects population growth, forcing new development adjacent to wild lands and flood prone areas. These factors, coupled with changes in weather patterns and rainfall, have heightened loss potential. The insured loss for the year 2008 fires in California alone was $2 billion. More than seven million homes in California are in areas categorized in the three highest fire-risk levels. Insurers are also exposed to increasing flood losses for commercial and industrial properties.

Only a few years ago, several large wildfires in southern California dominated media headlines as they encroached on the suburbs surrounding both San Diego and Los Angeles. In total, about 500,000 acres of land (about the size of Rhode Island) were burned. In addition, a total of 3,581 homes, a countless number of vehicles and a number of commercial buildings were destroyed, disrupting hundreds of thousands of people's lives. Given this level of destruction, it is apparent that a real need exists for some type of device or apparatus which could be used to safeguard homes and other structures from the risks of being damaged or destroyed by brush fires or forest fires other than the conventional fire extinguishers which are lacking in capacity to fight prolonged fires.

Accordingly, a need remains for a device in order to overcome the above-noted shortcomings. The present invention satisfies such a need by providing an indoor fire hydrant that is convenient and easy to use, is durable yet lightweight in design, is versatile in its applications, and provides a user with an easy and accessible means of fighting the spread of a fire in and around the house.

BRIEF SUMMARY OF THE INVENTION

In view of the foregoing background, it is therefore an object of the present invention to provide an apparatus for putting out fires inside a building structure. These and other objects, features, and advantages of the invention are provided by an indoor retractable fire extinguishing apparatus.

The indoor retractable fire extinguishing apparatus may include a portable fireproof casing adapted to be positioned inside the building structure. A spool may be rotatably situated inside the fireproof casing. A fire hose adapted to be connected to an existing water supply source located inside the building structure may be rolled up about the spool. A plurality of stabilizing plates may be statically mounted to the fireproof casing. A handle may be attached to the spool in such a manner that the handle and the spool may rotate in sync and thereby cause the fire hose to wind and unwind from the spool respectively while the stabilizing plates remain stationary exterior of the fireproof casing.

The stabilizing plates may further be directly attached to an outer surface of the fireproof casing such that operating forces acting on the handle and the spool are absorbed and distributed along the stabilizing plates thereby maintaining the fireproof casing at a substantially stable position during winding and unwinding operations. Such an arrangement provides the unexpected and unpredictable advantage of easily installing a fire hose within the confines of a home structure in place of the heavy duty fire hoses found in commercial buildings which are too heavy and bulky. The fire proof casing and stabilizer plates of the apparatus may further hold a reel of fire hose in a compact manner and thus allow the apparatus to be easily located within a home without taking much space.

The fireproof casing may include a plurality of planar walls configured in such a manner to provide a hollow cavity therebetween. A lid may be pivotally coupled to a rear one of the planar walls and thereby selectively covering an open top end of the fireproof casing. A front one of the planar walls may be provided with a notch extending downwardly from a top edge thereof. The notch may further define a travel path through which the fire hose passes during winding and unwinding operations. Such an arrangement provides the unexpected and unpredictable advantage of accessing and extracting the fire hose quickly and easily during a fire emergency. The notch further allows the fire hose to be flexibly rolled from the casing in a lateral direction without getting stuck as is likely when such a hose is being extracted from a compact housing.

The apparatus may further include a plurality of first apertures formed in the left and right ones of the planar walls respectively. A plurality of second apertures may further be formed in the left and right ones of the stabilizing plates respectively. In this way, a first end of the spool may be penetrated through the first pair of the first and second apertures and a second end of the spool may be penetrated through the second pair of the first and second apertures respectively. The first and second ends of the spool may remain axially aligned at the left and right stabilizing plates and thereby evenly distribute the operating forces away from the fireproof casing and to the left and right stabilizing plates. Such an arrangement provides the unexpected and unpredictable advantage of maintaining the apparatus in an upright position when the hose is rolled out from the spool. One skilled in the art may appreciate that the uncoiling of such stiff fire hoses may result in the casing being displaced from its upright position due to the forces involved.

The apparatus may further include an annular groove formed in an outer face of the left stabilizing plate such that the handle may be rotatably interfitted in the groove and thereby maintains direct contact with the first end of the spool. An end cap may be statically coupled to the second end of the spool and may further be synchronously rotated therewith such that the end cap is rotatably abutted against an outer face of the right stabilizing plate and thereby prevents the second end of the spool from disengaging the second pair of the first and second apertures. The handle may be located exterior of the fireproof casing and remains spaced therefrom and further be directly coupled to the left stabilizing plate and the first end of the spool respectively. Such an arrangement provides the unexpected and unpredictable advantage of providing an easy and smooth coiling and uncoiling operations of the spool by having an integral positioning of the rotating parts. The arrangement further allows the apparatus to be constructed using a minimum of parts.

The apparatus may further include a plurality of holes formed in the handle and the left stabilizing plate respectively. The handle may include a locking arm pivotally interfitted through the holes and thereby prevents the spool from rotating. Such an arrangement provides the unexpected and unpredictable advantage of ensuring that the fire hose is not accidentally uncoiled when stowed in the casing.

The invention may include a method of utilizing an indoor retractable fire extinguishing apparatus for putting out fires inside a building structure. Such a method may include the chronological steps of: providing a portable fireproof casing; positioning the fireproof casing inside the building structure; providing and rotatably situating a spool inside the fireproof casing; providing and connecting a fire hose to an existing water supply source located inside the building structure; rolling up the fire hose about the spool; providing and statically mounting a plurality of stabilizing plates to the fireproof casing; directly attaching the stabilizing plates to an outer surface of the fireproof casing such that operating forces acting on the handle and the spool are absorbed and distributed along the stabilizing plates thereby maintaining the fireproof casing at a substantially stable position during winding and unwinding operations; providing and attaching a handle to the spool; synchronously rotating the handle and the spool; and winding and unwinding the fire hose from the spool respectively while the stabilizing plates remain stationary exterior of the fireproof casing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
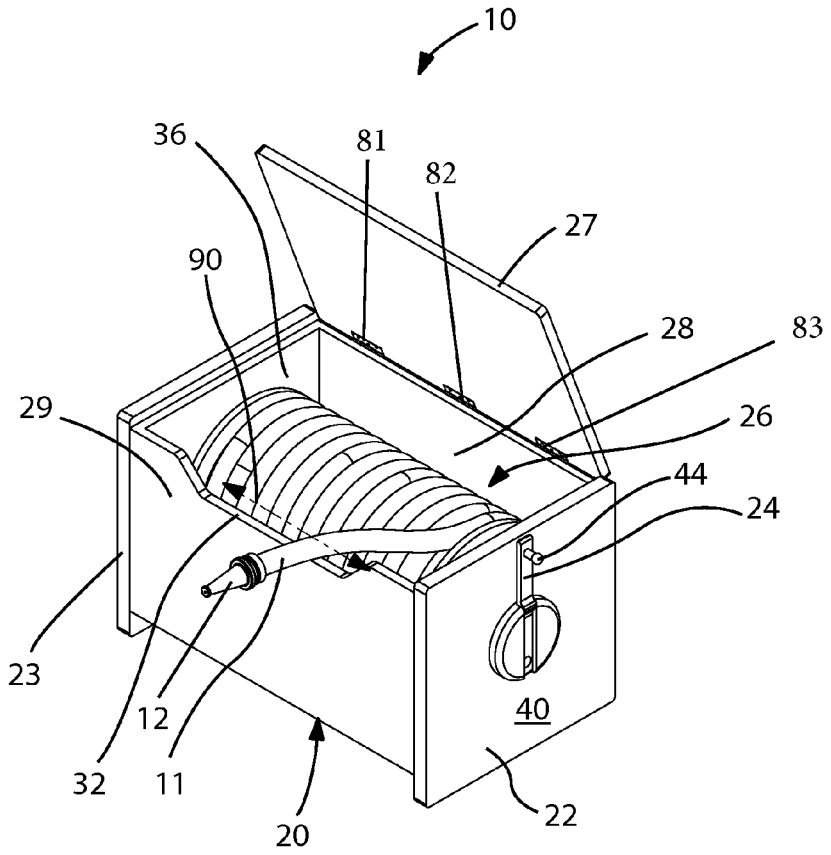
FIG. 1 is a perspective view showing an indoor retractable fire extinguishing apparatus, taken from a left side thereo, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The apparatus of this invention is referred to generally in FIGS. 1-6 by the reference numeral 10 and is intended to provide an indoor retractable fire extinguishing apparatus. It should be understood that the indoor retractable fire extinguishing apparatus 10 may be used to fight the spread of a fire in and around the house and many different types of buildings.

Figure 2:
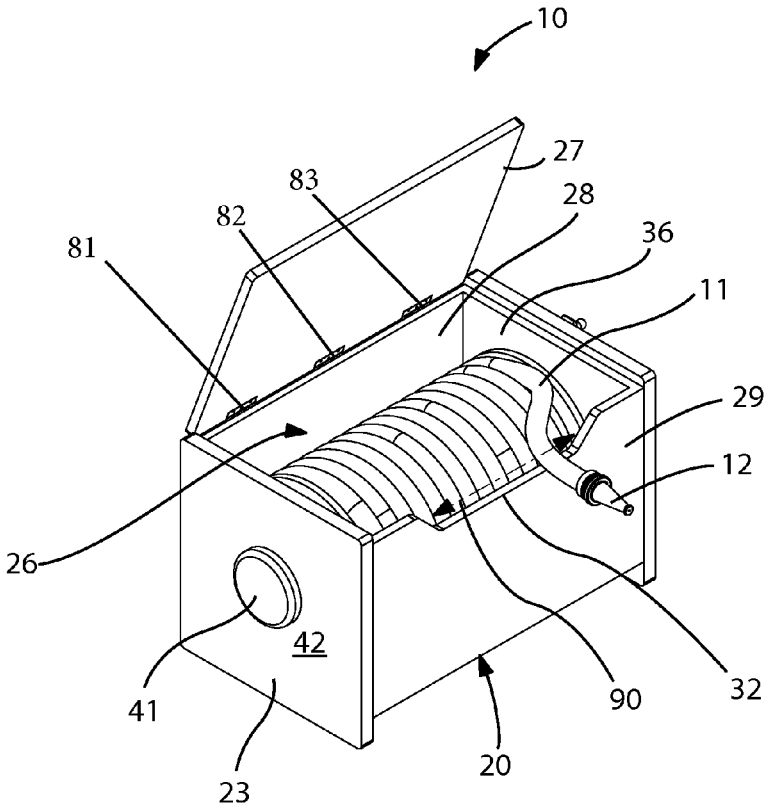
FIG. 2 is another perspective view of the apparatus shown in FIG. 1, taken from a right side thereof.
Figure 3:
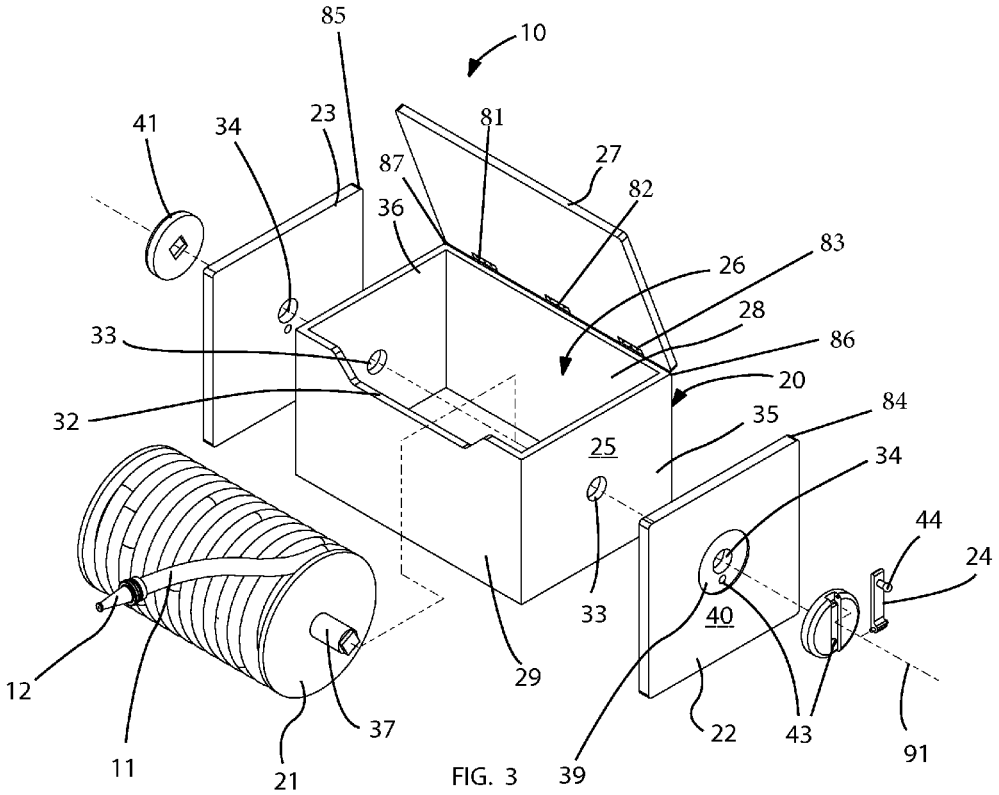
FIG. 3 is an exploded view of the apparatus shown in FIG. 1.
Figure 4:
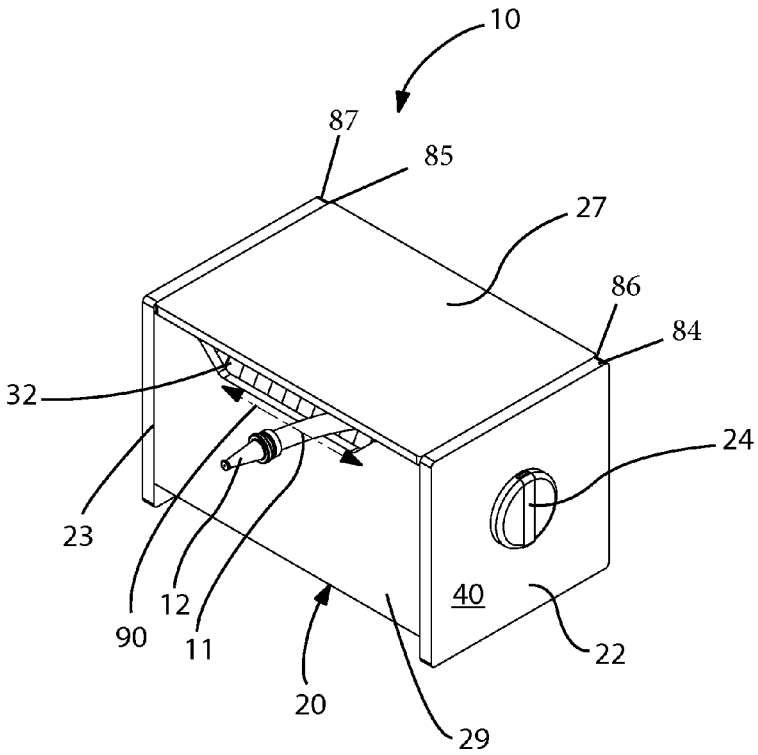
FIG. 4 is a perspective view of the apparatus with the lid closed.
Figure 5:
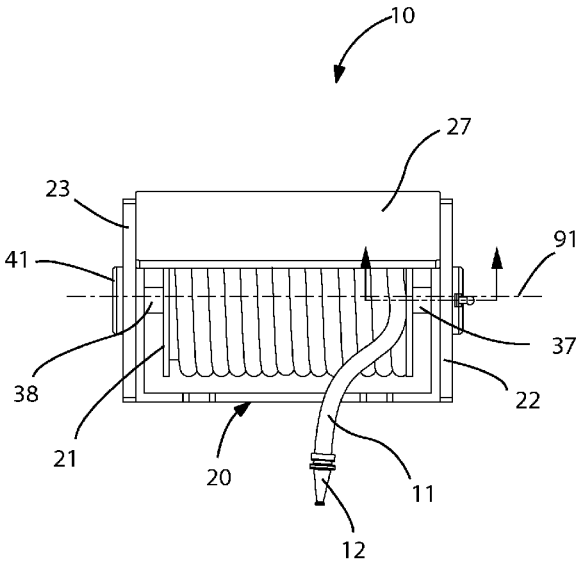
FIG. 5 is a top plan view of the apparatus shown in FIG. 1.
Figure 6:
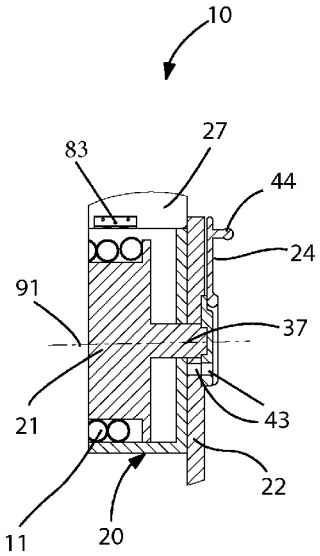
FIG. 6 is a cross-sectional view of the apparatus along line 6-6 shown in FIG. 5.

Referring generally to FIGS. 1-6, the indoor retractable fire extinguishing apparatus 10 preferably includes a portable fireproof casing 20 adapted to be positioned inside the building structure. Referring to FIGS. 3, 5 and 6, a spool 21 may be rotatably situated inside the fireproof casing 20. A fire hose 11 adapted to be connected to an existing water supply source located inside the building structure and may further be rolled up about the spool 21.

Advantageously, a plurality of stabilizing plates 22, 23 may be statically mounted to the fireproof casing 20. A handle 24 may be attached to the spool 21 in such a manner that the handle 24 and the spool 21 rotates in sync and thereby cause the fire hose 11 to wind and unwind from the spool 21 respectively while the stabilizing plates 22, 23 remain stationary and exterior of the fireproof casing 20. Such a structural configuration provides the unexpected and unpredictable advantage of ensuring the fireproof casing 20 remains at a substantially horizontal position without vibrating so that spool 21 stays evenly aligned inside the fireproof casing 20. This advantage permits the fire hose 11 to smoothly egress and ingress from the fireproof casing 20 during extend use.

As shown in FIG. 3, the stabilizing plates 22, 23 may be directly attached to an outer surface 25 of the fireproof casing 20 such that operating forces acting on the handle 24 and the spool 21 are absorbed and distributed along the stabilizing plates 22, 23 thereby maintaining the fireproof casing 20 at a substantially stable position during winding and unwinding operations. Such an arrangement provides the unexpected and unpredictable advantage of easily winding and unwinding a fire hose 11 within the confines of a home structure in place of the heavy duty fire hoses found in commercial buildings which are too heavy and bulky. The fire proof casing 20 and stabilizer plates 22, 23 of the apparatus 10 may further hold a reel of fire hose 11 in a compact manner and thus allow the apparatus 10 to be easily located within a home without taking much space.

Referring to FIGS. 1-3, the fireproof casing 20 may include a plurality of planar walls 28, 29, 35, 36 configured in such a manner to provide a hollow cavity 26 therebetween. A lid 27 may be pivotally coupled to a rear one 28 of the planar walls 28, 29, 35, 36 and thereby selectively cover an open top end of the fireproof casing 20. A front one 29 of the planar walls may be provided with a notch 32 extending downwardly from a top edge thereof. The notch 32 may further define a travel path 90 through which the fire hose 11 passes during winding and unwinding operations. Such an arrangement provides the unexpected and unpredictable advantage of accessing and extracting the fire hose 11 quickly and easily during a fire emergency. The notch 32 further allows the fire hose 11 to be flexibly rolled from the casing 20 in a lateral direction without getting stuck as is likely when such a hose is being extracted from a compact housing.

As shown in FIGS. 3, 5 and 6, the apparatus 10 may further include a plurality of first apertures 33 formed in left and right ones 35, 36 of the planar walls, respectively. A plurality of second apertures 34 may be formed in left and right ones 22, 23 of the stabilizing plates 22, 23, respectively. In this way, a first end 37 of spool 21 may be penetrated through a first pair of the first and second apertures 33, 34 and a second end 38 of the spool 21 may be penetrated through a second pair of the first and second apertures 33, 34, respectively. The first and second ends 37, 38 of the spool 21 may remain axially aligned 91 at the left and right stabilizing plates 22, 23 and thereby evenly distribute the operating forces away from the fireproof casing 20; to the left and right stabilizing plates 22, 23. Such an arrangement provides the unexpected and unpredictable advantage of maintaining the apparatus 10 in an upright position when the hose 11 is quickly rolled out and in to the spool 21. During prolonged use, hoses become deformed and stiff thereby losing their resiliency. Such stiffness and deformation of the hose causes increased friction with a spool and irritates the winding and unwinding process. The above-described structural configuration overcomes such shortcomings.

As best shown in FIG. 3, the apparatus 10 may further include an annular groove 39 formed in an outer face 40 of the left stabilizing plate 22 such that the handle 24 may be rotatably interfitted in the groove 39 and thereby maintains direct contact with the first end 37 of the spool 21. As shown in FIGS. 2 and 5, an end cap 41 may be statically coupled to the second end 38 of the spool 21 and may further be synchronously rotated therewith such that the end cap 41 is rotatably abutted against an outer face 42 of the right stabilizing plate 23; thereby preventing the second end 38 of the spool 21 from disengaging the second pair of the first and second apertures 33, 34. The handle 24 may be located exterior of the fireproof casing 20 and remains spaced therefrom and further may be directly coupled to the left stabilizing plate 22 and the first end 37 of the spool 21, respectively. Such an arrangement provides the unexpected and unpredictable advantage of providing smooth winding and unwinding operations of the spool 21. The arrangement further allows the apparatus 10 to be constructed using a minimum number of parts.

Referring to FIGS. 1, 3 and 6, the apparatus 10 may further include a plurality of holes 43 formed in the handle 24 and the left stabilizing plate 22 respectively. The handle 24 may include a locking arm 44 pivotally interfitted through the holes 43 and thereby prevents the spool 21 from rotating. Such an arrangement provides the unexpected and unpredictable advantage of ensuring that the fire hose 11 is not accidentally uncoiled when stowed in the fireproof casing 20. A plurality of hinges 81, 82, 83 are directly coupled to a top longitudinal edge of the rear planar wall 28 and a bottom longitudinal edge of the lid 27. Such hinges 81, 82, 83 remain entirely spaced from each of the stabilizing plates 22, 23 as well as left and right ones 35, 36 of the planar walls. Each of the stabilizing plates 22, 23 has a linear rear edge 84, 85, respectively, and the rear planar wall 28 has opposed linear side edges 86, 87. The stabilizing plates 22, 23 do not extend rearward of the rear planar wall 28 such that the linear rear edges 84, 85 are coplanar with the linear side edges 86, 87.

The present invention may further include a method of utilizing an indoor retractable fire extinguishing apparatus 10 for putting out fires inside a building structure. Such a method may include the chronological steps of: providing a portable fireproof casing 20; positioning the fireproof casing 20 inside the building structure; providing and rotatably situating a spool 21 inside the fireproof casing 20; providing and connecting a fire hose 11 to an existing water supply source located inside the building structure; and rolling up the fire hose 11 about the spool 21.

The method may further include the chronological steps of: providing and statically mounting a plurality of stabilizing plates 22, 23 to the fireproof casing 20; directly attaching the stabilizing plates 22, 23 to an outer surface 25 of the fireproof casing 20 such that operating forces acting on the handle 24 and the spool 21 are absorbed and distributed along the stabilizing plates 22, 23 thereby maintaining the fireproof casing 20 at a substantially stable position during winding and unwinding operations; providing and attaching a handle 24 to the spool 21; synchronously rotating the handle 24 and the spool 21; and winding and unwinding the fire hose 11 from the spool 21, respectively, while the stabilizing plates 22, 23 remain stationary and exterior of the fireproof casing 20. The combination of such claimed elements provides an unpredictable and unexpected benefit of providing an indoor fire extinguishing apparatus 10, which is stable and not prone to breakage during extended use.

Referring again to FIGS. 1-6 in general, the apparatus 10 may be connected to the household plumbing of a residence or many different types of plumbing systems. The apparatus 10 may be easily accessed by unrolling the fire hose 11 from its fireproof casing 20 allowing users to fight indoor fires in a timely manner. The fire hose 11 may be adjusted to spread the water spray by use of the nozzle 12 on the end of the hose 11 or it may be narrowed to apply more water pressure to a fire. After using the fire hose 11, it may be rolled back into the fireproof casing 20 using the rolling handle 24, which may be folded back into the apparatus 10.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. An indoor retractable fire extinguishing apparatus for putting out fires inside a building structure, said indoor retractable fire extinguishing apparatus comprising:

a portable fireproof casing adapted to be positioned inside the building structure;

a spool rotatably situated inside said fireproof casing;

a fire hose adapted to be connected to an existing water supply source located inside the building structure, said fire hose being rolled up about said spool;

a plurality of stabilizing plates mounted to said fireproof casing; wherein said plurality of stabilizing plates include a left stabilizing plate and a right stabilizing plate; and a handle attached to said spool in such a manner that said handle and said spool rotating in sync and thereby cause said fire hose to wind and unwind from said spool respectively while said stabilizing plates remain exterior of said fireproof casing;

wherein said stabilizing plates are attached to an outer surface of said fireproof casing such that operating forces acting on said handle and said spool are absorbed and distributed along said stabilizing plates thereby maintaining said fireproof casing at a substantially stable position during winding and unwinding operations;

wherein said fireproof casing comprises at least four planar walls configured in such a manner to provide a hollow cavity therebetween;

a lid pivotally coupled to a rear one of said planar walls and thereby selectively covering an open top end of said fireproof casing; and a plurality of hinges directly coupled to a bottom longitudinal edge of said rear planar wall and a top longitudinal edge of said lid;

wherein a front one of said planar walls is provided with a notch extending downwardly from a top edge thereof, said notch defining a travel path through which said fire hose passes during winding and unwinding operations;

wherein said hinges remain entirely spaced from each of said stabilizing plates as well as left and right ones of said planar walls;

wherein each of said stabilizing plates has a linear rear edge;

wherein said rear planar wall has opposed linear side edges;

wherein said stabilizing plates do not extend rearward of said rear planar wall such that said linear rear edge is coplanar with said linear side edge.

2. The indoor retractable fire extinguishing apparatus of claim 1, further comprising:

a plurality of first apertures formed in said left and right ones of said planar walls respectively; and a plurality of second apertures formed in said left stabilizing plate and said right stabilizing plate, respectively;

wherein a first end of said spool is penetrated through a first pair of said first and second apertures;

wherein a second end of said spool is penetrated through a second pair of said first and second apertures;

wherein said first and second ends of said spool remaining axially aligned at said left stabilizing plate and said right stabilizing plate and thereby evenly distribute the operating forces away from said fireproof casing and to said left stabilizing plate and said right stabilizing plate.

3. The indoor retractable fire extinguishing apparatus of claim 2, further comprising:

an annular groove formed in an outer face of said left stabilizing plate, said handle being rotatably interfitted in said groove and thereby maintaining direct contact with said first end of said spool; and an end cap statically coupled to said second end of said spool and being synchronously rotated therewith;

wherein said end cap is rotatably abutted against an outer face of said right stabilizing plate and thereby prevents said second end of said spool from disengaging said second pair of said first and second apertures.

4. The indoor retractable fire extinguishing apparatus of claim 2, wherein said handle is located exterior of said fireproof casing and remains spaced therefrom, said handle being directly coupled to said left stabilizing plate and said first end of said spool respectively.

5. The indoor retractable fire extinguishing apparatus of claim 1, further comprising: a plurality of holes formed in said handle and said left stabilizing plate respectively, said handle including a locking arm pivotally interfitted through said holes and thereby preventing said spool from rotating.

6. An indoor retractable fire extinguishing apparatus for putting out fires inside a building structure, said indoor retractable fire extinguishing apparatus comprising:

a portable fireproof casing adapted to be positioned inside the building structure;

a spool rotatably situated inside said fireproof casing;

a fire hose adapted to be connected to an existing water supply source located inside the building structure, said fire hose being rolled up about said spool;

a plurality of stabilizing plates statically mounted to said fireproof casing; wherein said plurality of stabilizing plates include a left stabilizing plate and a right stabilizing plate; and a handle attached to said spool in such a manner that said handle and said spool rotating in sync and thereby cause said fire hose to wind and unwind from said spool respectively while said stabilizing plates remain stationary exterior of said fireproof casing;

wherein said stabilizing plates are directly attached to an outer surface of said fireproof casing such that operating forces acting on said handle and said spool are absorbed and distributed along said stabilizing plates thereby maintaining said fireproof casing at a substantially stable position during winding and unwinding operations;

wherein said fireproof casing comprises at least four planar walls configured in such a manner to provide a hollow cavity therebetween;

a lid pivotally coupled to a rear one of said planar walls and thereby selectively covering an open top end of said fireproof casing; and a plurality of hinges directly coupled to a top longitudinal edge of said rear planar wall and a bottom longitudinal edge of said lid;

wherein a front one of said planar walls is provided with a notch extending downwardly from a top edge thereof, said notch defining a travel path through which said fire hose passes during winding and unwinding operations;

wherein said hinges remain entirely spaced from each of said stabilizing plates as well as left and right ones of said planar walls;

wherein each of said stabilizing plates has a linear rear edge;

wherein said rear planar wall has opposed linear side edges;

wherein said stabilizing plates do not extend rearward of said rear planar wall such that said linear rear edge is coplanar with said linear side edge.

7. The indoor retractable fire extinguishing apparatus of claim 6, further comprising:

a plurality of first apertures formed in said left and right ones of said planar walls respectively; and a plurality of second apertures formed in left stabilizing plate and said right stabilizing plate respectively;

wherein a first end of said spool is penetrated through a first pair of said first and second apertures;

wherein a second end of said spool is penetrated through a second pair of said first and second apertures;

wherein said first and second ends of said spool remaining axially aligned at said left stabilizing plate and said right stabilizing plate and thereby evenly distribute the operating forces away from said fireproof casing and to said left stabilizing plate and said right stabilizing plate.

8. The indoor retractable fire extinguishing apparatus of claim 7, further comprising:

an annular groove formed in an outer face of said left stabilizing plate, said handle being rotatably interfitted in said groove and thereby maintaining direct contact with said first end of said spool; and an end cap statically coupled to said second end of said spool and being synchronously rotated therewith;

wherein said end cap is rotatably abutted against an outer face of said right stabilizing plate and thereby prevents said second end of said spool from disengaging said second pair of said first and second apertures.

9. The indoor retractable fire extinguishing apparatus of claim 7, wherein said handle is located exterior of said fireproof casing and remains spaced therefrom, said handle being directly coupled to said left stabilizing plate and said first end of said spool respectively.

10. The indoor retractable fire extinguishing apparatus of claim 6, further comprising: a plurality of holes formed in said handle and said left stabilizing plate respectively, said handle including a locking arm pivotally interfitted through said holes and thereby preventing said spool from rotating.

11. A method of utilizing an indoor retractable fire extinguishing apparatus for putting out fires inside a building structure, said method comprising the chronological steps of:

providing a portable fireproof casing;

positioning said fireproof casing inside the building structure;

providing and rotatably situating a spool inside said fireproof casing;

providing and connecting a fire hose to an existing water supply source located inside the building structure;

rolling up said fire hose about said spool;

providing and statically mounting a plurality of stabilizing plates to said fireproof casing;

directly attaching said stabilizing plates to an outer surface of said fireproof casing such that operating forces acting on said handle and said spool are absorbed and distributed along said stabilizing plates thereby maintaining said fireproof casing at a substantially stable position during winding and unwinding operations;

providing and attaching a handle to said spool;

synchronously rotating said handle and said spool; and winding and unwinding said fire hose from said spool respectively while said stabilizing plates remain stationary exterior of said fireproof casing;

wherein said fireproof casing comprises at least four planar walls configured in such a manner to provide a hollow cavity therebetween;

a lid pivotally coupled to a rear one of said planar walls and thereby selectively covering an open top end of said fireproof casing; and a plurality of hinges directly coupled to a top longitudinal edge of said rear planar wall and a bottom longitudinal edge of said lid;

wherein a front one of said planar walls is provided with a notch extending downwardly from a top edge thereof, said notch defining a travel path through which said fire hose passes during winding and unwinding operations;

wherein said hinges remain entirely spaced from each of said stabilizing plates as well as left and right ones of said planar walls;

wherein each of said stabilizing plates has a linear rear edge;

wherein said rear planar wall has opposed linear side edges;

wherein said stabilizing plates do not extend rearward of said rear planar wall such that said linear rear edge is coplanar with said linear side edge.

* * * * *